US005243926A

United States Patent [19]

Wright et al.

[11] Patent Number: 5,243,926

[45] Date of Patent: Sep. 14, 1993

[54] APPARATUS FOR SECURING WATERCRAFT TO A DOCK

[76] Inventors: Terrell S. Wright, 4305 Bon Dell Dr.; William H. Wright, 3549 W. Lakeside Dr., both of Birmingham, Ala. 35243

[21] Appl. No.: 985,223

[22] Filed: Dec. 2, 1992

Related U.S. Application Data

[63] Continuation of Ser. No. 810,892, Dec. 20, 1991, abandoned.

[51] Int. Cl.[5] ..... B63B 21/00

[52] U.S. Cl. ..... 14/230

[58] Field of Search ..... 114/230, 250, 249

[56] References Cited

U.S. PATENT DOCUMENTS 2,912,953 11/1959 Olsen ..... 114/230
2,979,014 4/1961 Yordi ..... 114/230
3,064,615 11/1962 Waltman ..... 114/230
4,144,831 3/1979 Heydolph ..... 114/230
4,686,926 8/1987 Vance ..... 114/250 X

*Primary Examiner*—Sherman Basinger
*Attorney, Agent, or Firm*—Pettis & McDonald

[57] ABSTRACT

An apparatus for safely securing a boat to a dock having a first bracket attached to the boat and a second bracket attached to the dock. Interposed between the two brackets is a telescoping arm including a tension spring, and each end of the arm is pivotally attached to a respective one of the brackets. The telescoping arm is pivotally attached to each bracket to permit movement of the boat with respect to the dock, and the tension spring assists in ensuring that the boat does not inadvertently strike the dock. The apparatus may also include a compression spring positioned to act against one end of the sliding arm as a further cushion against lateral movement of the boat toward the dock.

2 Claims, 3 Drawing Sheets

APPARATUS FOR SECURING WATERCRAFT TO A DOCK

CROSS REFERENCE TO RELATED APPLICATIONS

This application is a continuation of our prior application Ser. No. 07/810,892, filed Dec. 20, 1991, now abandoned.

SUMMARY OF THE INVENTION

The object of this invention is to provide for quick and secure mooring of a watercraft. It provides fixed, stationary positioning for the watercraft relative to that of its docking facility. When the watercraft's relative position to its docking facility is pressured by influences, such as water level changes (vertical) or wind, waves and current (horizontal), this invention will accommodate this pressure, and will return the watercraft to its previous position once the pressure is no longer present. This effort is accomplished without damage to the watercraft or docking facility and is done without ropes and bumpers as is the traditional method of mooring.

This is a useful invention in that it eliminates certain problems associated with the use of traditional ropes to moor a boat. The roping of a boat will require some slack in order to accommodate water level changes. This slack allows for movement and possible further slack in the rope(s) holding the watercraft; movement allows for contact of the watercraft with other watercraft or the docking facility—which can damage all surfaces in contact. Also, traditional roping does not, by itself deter theft.

This invention accomplishes its purpose through its design using tubular steel and springs. A telescoping arm is formed using tubular steel with a spring inserted in close proximity to the "dock" end of the arm. The arm is secured to receivers mounted on the docking facility and the watercraft. The receivers and the telescoping feature of the arm allow for vertical pivoting (to 45 degrees below horizontal) to accommodate a change (usually a drop) in water level while preventing contact between watercraft and the docking facility. The receivers will not allow horizontal movement. When horizontal pressure (wind, waves, current, pushing/pulling,,etc.) is exerted on the watercraft, the spring acts to allow the watercraft to "give" in the direction of the pressure, but not so much as to allow for contact between the watercraft and the docking facility. An additional compression spring, within the body of the arm acts as a shock absorber or bumper to soften inward, near perpendicular, horizontal pressure on the watercraft.

In essence, the springs act to soften horizontal pressure and return the watercraft back to its fixed, stationary position relative to its docking facility, once the pressure subsides. This invention will not work as a rigid arm, (without springs) due to excessive torque, stress and wear created by horizontal pressures and movement resulting in damage to the watercraft, the docking facility, and all components of this invention.

In addition, the design of this invention will allow for the use of a bolt, pin or lock to be used to secure the arm in position in the receiver, providing for a fail-safe mooring. Also, the use of a simple padlock in place of a bolt or pin will serve to deter theft of the watercraft.

BRIEF DESCRIPTION OF THE DRAWINGS

Apparatus embodying features of this invention is depicted in the attached drawings, which form a portion of this application, and wherein.

Similar reference characters refer to similar parts throughout the several views of the drawings.

DETAILED DESCRIPTION

Figure 2:
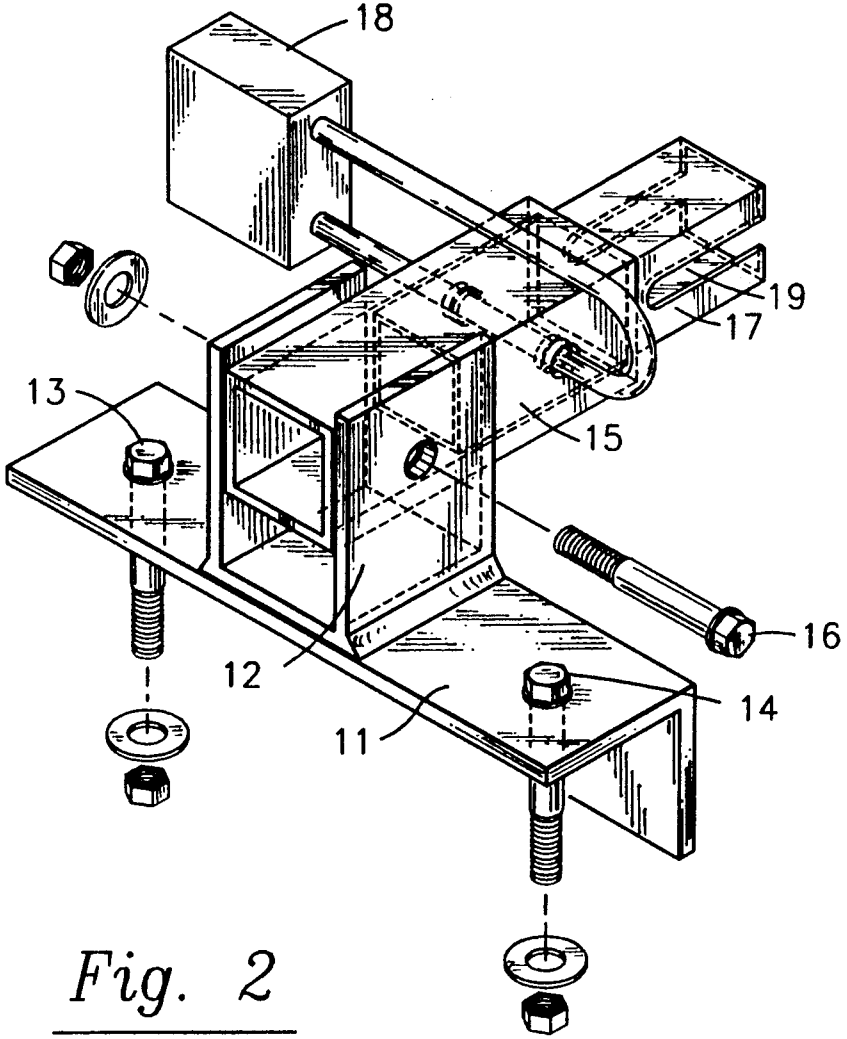
FIG. 2 is a perspective view of the end of the apparatus to be secured to the watercraft.

Referring to FIG. 2, it may be seen that a steelangle 11 is employed with a U shaped saddle 12 welded thereto as a base to be bolted 13 and 14 to the watercraft. This application using a steel angle (FIGS. 2, 11) is designed for use on a deck or pontoon type watercraft with a flat, exposed deck. Application on other watercraft types with traditional hull design may require some modification to the receiver attachment on the watercraft. However, the operation of the springs and arm of this invention are not affected by modifications in the design of the receiver mounting on the watercraft. Vertical pivoting receiver tube 15 is pinned to this using bolt 16. This portion of the apparatus 11 thru 16 is left permanently attached to the watercraft when it is away from the dock.

When mooring the watercraft square slotted steel tube 17 is inserted into receiver 15 until the holes line up and is secured with lock 18. The external size of this square slotted tube 17 is slightly smaller than the internal dimension of the receiver 15 and is free to slide into proper position for locking.

Figure 1:
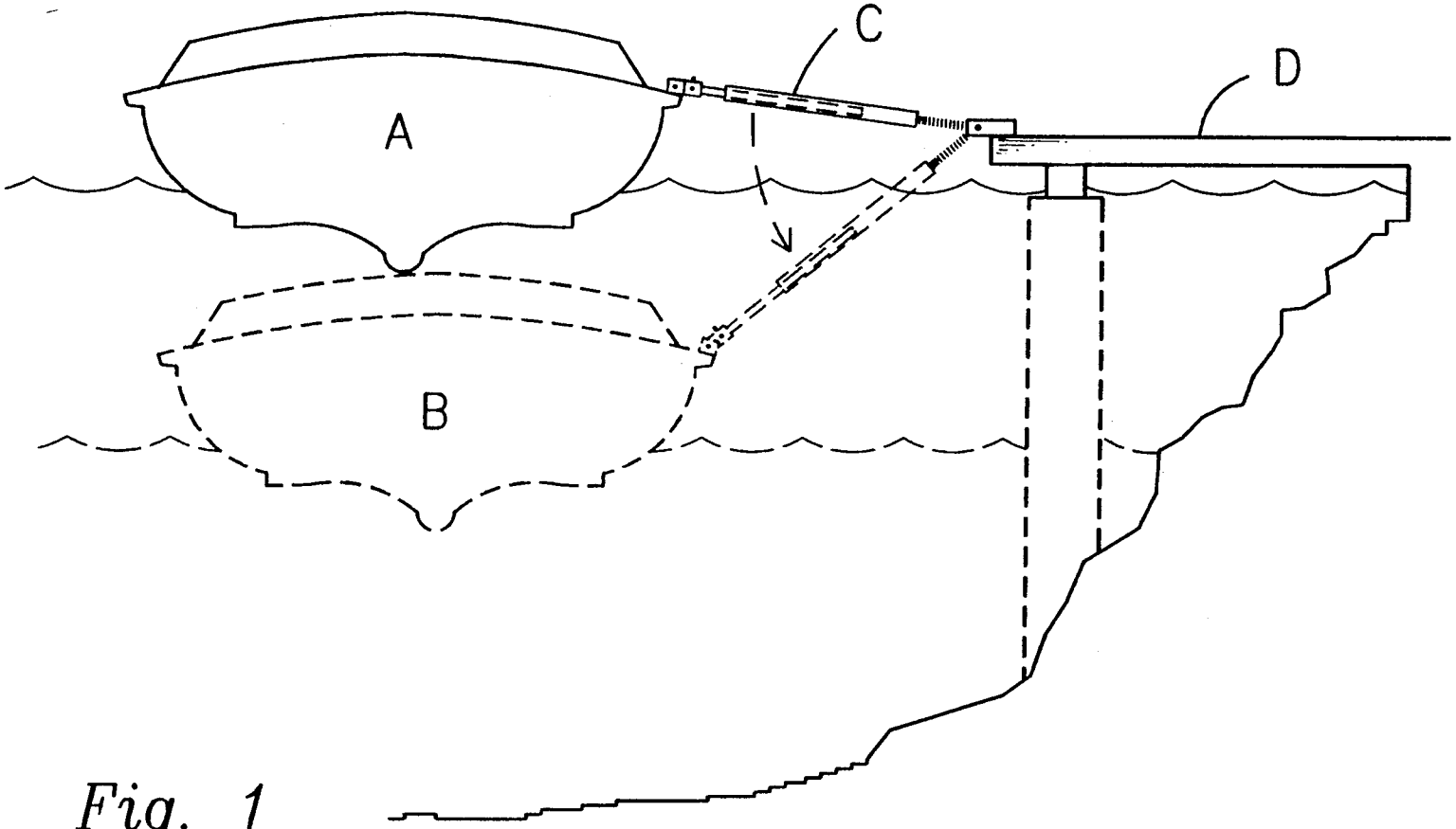
FIG. 1 is an elevational view showing the relationship of a watercraft moored to a pier or dock "D" with the invention "C" providing for movement from a high water position "A" to a low water position "B".
Figure 3:
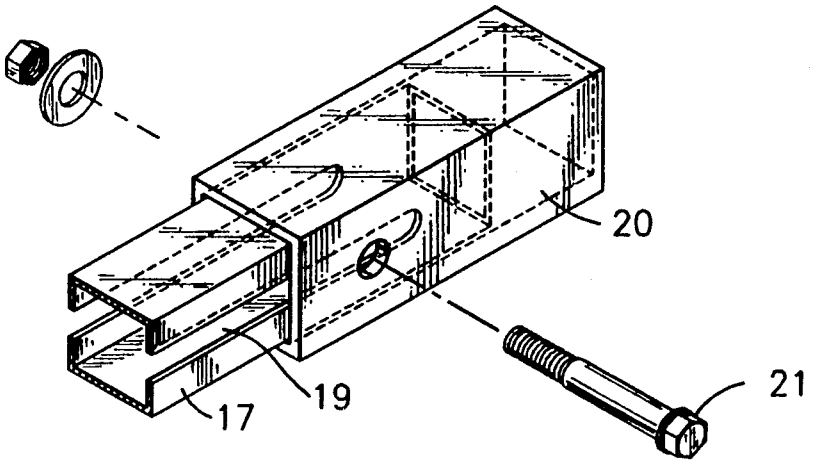
FIG. 3 is a perspective view of the telescoping center portion of the apparatus.

Square slotted tube 17 telescopes into main tube 20 and is free to slide out (as shown in FIG. 3) its full length until restrained by the end of slot 19 making contact with bolt 21.

Figure 4:
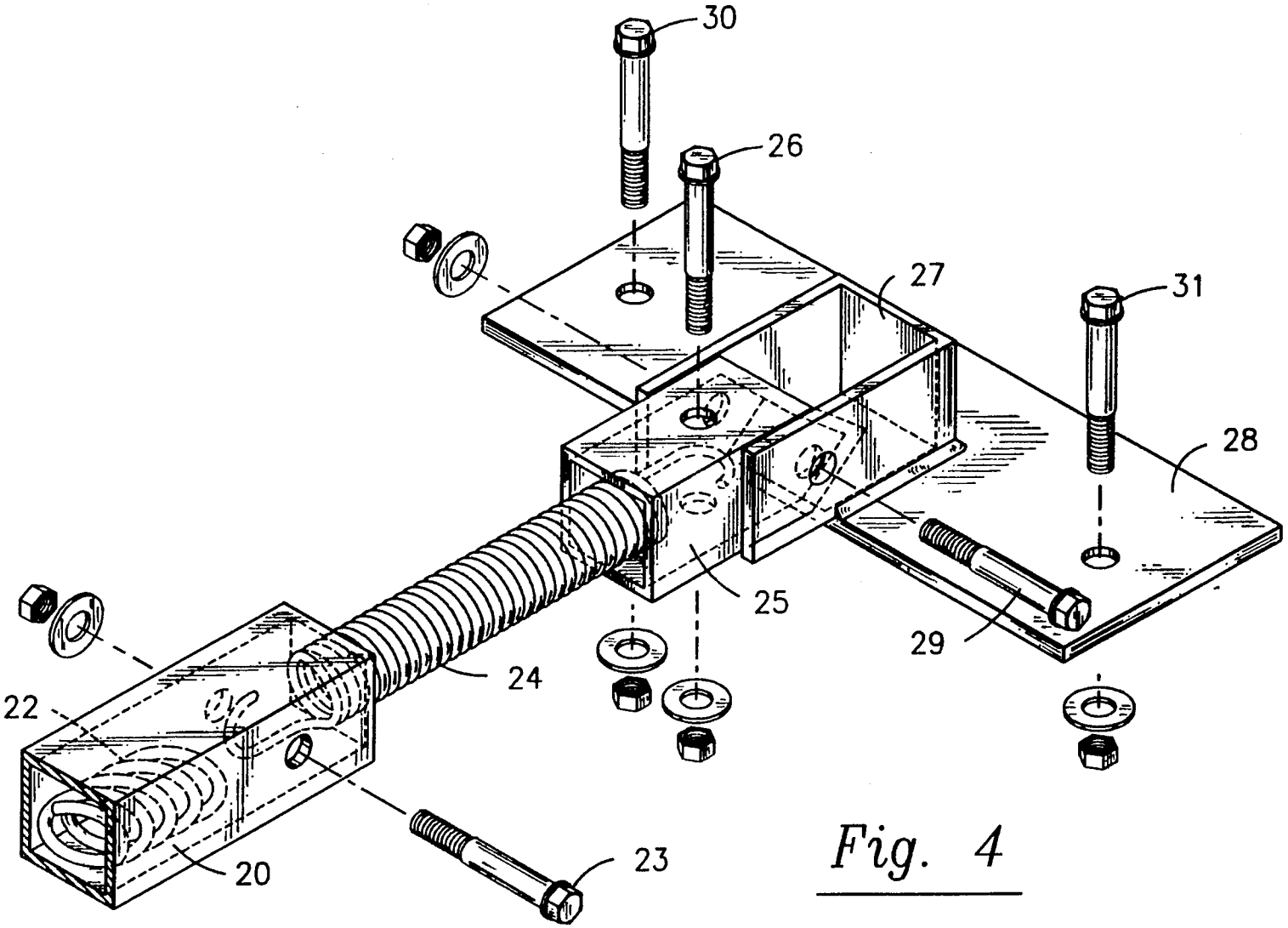
FIG. 4 is a perspective view of the end of the apparatus to be secured to the pier of dock.

Referring to FIG. 4 the main tube 20 which has the same internal size as the previously mentioned receiver 15 accommodates the full length of slotted tube 17 until it compresses spring 22 against bolt 23. This acts as a cushion to reduce impact of wave action and pushes the watercraft away from the dock. The actual length of slotted tube 17 and main tube 20 is determined by the amount of variation of the water level to be accommodated.

Another function of bolt 23 is to secure one end of tension spring 24. This spring which is a tight fit into the end of the body tube 20 is the stiff, but flexible element that allows the watercraft to move with wave and wind action and then return to its original position. The other end of spring 24 fits into the end of the vertical pivoting dock tube 25 and is secured by bolt 26.

The vertical pivoting dock tube 25 is pinned by bolt 29. to the U shaped saddle 27 welded to base plate 28 which in turn is bolted 30 & 31 securely to the dock or pier. It is intended that the relationship of the horizontal bolt 29 through the vertical pivoting dock tube 25 and the saddle 27 base plate 28 unit be such that downward angle of the apparatus be limited to approximately 45 degrees preventing any possibility of the watercraft coming in contact with dock or pier.

We claim:

1. Apparatus for securing a watercraft to a dock, said apparatus comprising:

a base plate, said base plate having means for securing said base plate to said dock;

a first saddle, said first saddle being fixed to said base plate;

a dock tube, said dock tube being pinned to said first saddle so as to be able to pivot with respect thereto;

a tension spring, said tension spring being attached to said dock tube at a first end thereof;

a main tube, said tension spring being attached to a first end of said main tube at a second end of said tension spring;

a slotted tube, a first end of said slotted tube being received within a second end of said main tube so as to slide within said main tube;

a receiver tube, a second end of said slotted tube being received within a first end of said receiver tube, means for locking said receiver tube and said slotted tube together, a second saddle, said second saddle being pinned to a second end of said receiver tube so as to be able to pivot with respect thereto;

and a steelangle, said steelangle being fixed to said second saddle;

and having means for securing said steelangle to said watercraft.

2. Apparatus for securing a watercraft to a dock as in claim 1, said apparatus further comprising:

a compression spring, said compression spring extending within said second end of said main tube, said compression spring acting against the first end of said slotted tube to reduce the impact of wave action on said watercraft.

* * * * *